United States Patent [19]

Iizuka et al.

[11] Patent Number: 4,528,927

[45] Date of Patent: Jul. 16, 1985

[54] PLANING TYPE BOAT

[75] Inventors: Yoshinori Iizuka, Tanuma; Kazuo Kobori, Sano, both of Japan

[73] Assignee: 501 Achilles Corporation, Tokyo, Japan

[21] Appl. No.: 526,111

[22] Filed: Aug. 24, 1983

[30] Foreign Application Priority Data

Mar. 22, 1983 [JP] Japan ..... 58-47588

[51] Int. Cl.[3] ..... B63B 39/03

[52] U.S. Cl. ..... 114/125; 114/345; 114/288

[58] Field of Search ..... 114/125, 288, 345, 333, 114/289

[56] References Cited

U.S. PATENT DOCUMENTS 2,223,625 12/1940 Krupp ..... 114/345
2,683,269 7/1954 Harkins ..... 114/125
3,327,672 6/1967 Field ..... 114/125

FOREIGN PATENT DOCUMENTS 231018 3/1959 Australia ..... 114/125
616373 3/1980 Switzerland ..... 114/125

*Primary Examiner*—Trygve M. Blix
*Assistant Examiner*—Thomas J. Brahan
*Attorney, Agent, or Firm*—Ladas & Parry

[57] ABSTRACT

A planing type boat having a water ballast chamber provided at the bottom of the boat includes a partition wall provided in the water ballast chamber to divide the chamber into front and rear compartments and formed with an opening for communicating these compartments with each other. In the initial stage of planing, the water in the rear compartment is fastly discharged due to a combined action of inertia, gravity and aspiration induced by the outside flow whereas the water in the front compartment which is restricted in its rearward flow by the partition wall structure is discharged relatively slowly as compared with the water in the rear compartment. The weight of the water therefore substantially acts on the front compartment in the initial stage of planing thereby effectively preventing the bow of the boat from being excessively lifted with the result that the time required for entering a complete planing is minimized.

4 Claims, 6 Drawing Figures

PLANING TYPE BOAT

BACKGROUND OF THE INVENTION

This invention relates to a planing type boat and, more particularly, to a planing type runabout capable of being driven at high speeds by an engine such as an outboard motor.

There has been known a planing type boat which, for improving the stability of the boat, has a water ballast in a chamber provided at the bottom of the boat. There has also been known a boat of this type which, as shown in FIG. 1 illustrating the boat in a planing state, has a water ballast chamber a formed with a water outlet b in the aft portion thereof and an air inlet c in the forward portion thereof. According to this latter structure, as the boat starts planing, water in the water ballast chamber a is automatically discharged by a combined action of inertia, gravity and aspiration induced by the outside flow of water whereby the weight of the boat is reduced and its buoyancy is increased resulting in improvement in the running performances of the boat.

In this prior art planing type boat, however, water is gradually replaced by air starting from the foremost end portion of the water ballast chamber a and this, coupled with driving of an outboard motor d, causes a bow f of the boat to be lifted excessively as shown in FIG. 2 at the start of planing. Such excessive lifting of the bow adversely affects the stability of the boat in the initial stage of planing resulting in prolongation of time required for entering a smooth planing state.

SUMMARY OF THE INVENTION

It is an object of this invention to provide a planing type boat of an excellent initial planing performance eliminating the above described disadvantage of the prior art boat having a water ballast chamber. This object of the invention is achieved by a planing type boat having a water ballast chamber provided at the bottom of the boat and comprising a partition wall provided in the water ballast chamber to divide the water ballast chamber into front and rear compartments and formed with an opening for communicating the front and rear compartments with each other, a rear wall of the rear compartment being formed with an opening, and communicating means provided in each of the front and rear compartments for communicating the inside of the front and rear compartments with the outside of the water ballast chamber.

According to the invention, the front and rear compartments of the water ballast chamber are filled with water coming therein mainly through the opening formed in the rear wall of the rear compartment when the boat is not in motion whereby the center of gravity of the boat is lowered and the waterline of the boat raised resulting in increase in the stability of the boat. In the initial stage of planing, the water in the rear compartment is fastly discharged due to a combined action of inertia, gravity and aspiration induced by the outside flow whereas the water in the front compartment which is restricted in its rearward flow by the partition wall structure is discharged relatively slowly as compared with the water in the rear compartment. The weight of the water therefore substantially acts on the front compartment in the initial state of planing thereby effectively preventing the bow of the boat from being excessively lifted with the result that the time required for entering a complete planing is minimized.

Other objects and features of the invention will become apparent from the description made hereinbelow with respect to the accompanying drawings.

BRIEF DESCRIPTION OF THE DRAWINGS

In the accompanying drawings.

DESCRIPTION OF PREFERRED EMBODIMENTS

Description will now be made about an embodiment in which the invention has been applied to a planing type boat having an end-open inflatable tube constituting a pair of sponsons and a bow portion generally known as a rubber boat.

Figure 1:
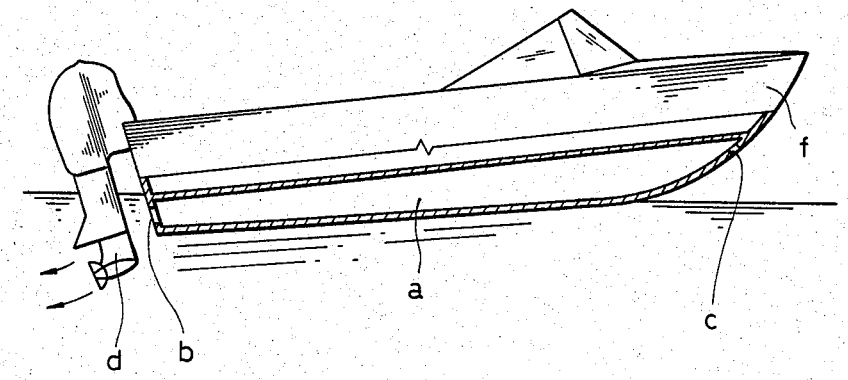
FIG. 1 PRIOR ART
FIG. 1 is a side view, partly in section, showing a prior art planing type boat having a water ballast chamber in a planing state.
Figure 2:
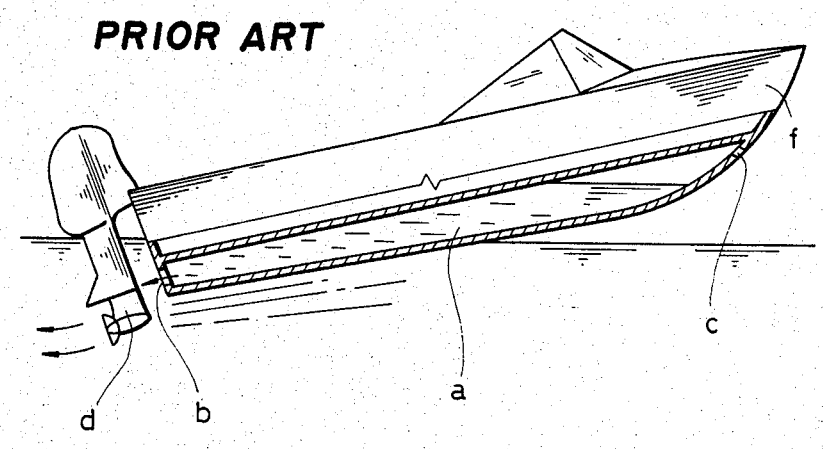
FIG. 2 PRIOR ART
FIG. 2 is a side view showing the prior art boat of FIG. 1 at the start of planing.
Figure 3:
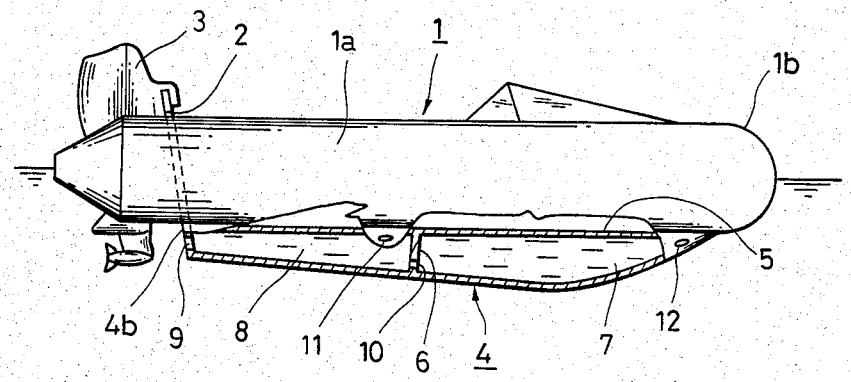
FIG. 3 is a partly sectional side view showing a planing type boat embodying the invention in a stationary state.

Referring to FIG. 3 and subsequent figures, the hull of the boat comprises an end-open inflatable tube 1 which is generally U-shaped when viewed in a plan. The tube constitutes a pair of laterally spaced sponson sections 1*a*, 1*a* connected together at the forward ends by a bow section 1*b*. The tube may be made of a rubber coated fabric or any other suitable material having sufficient flexibility and air-impervious and stretch resistant properties. A transom 2 is provided between aft end portions of the sponson sections 1*a*, 1*a* in a well known manner. An outboard motor 3 is mounted on the transom 2 also in a well known manner.

Figure 5:
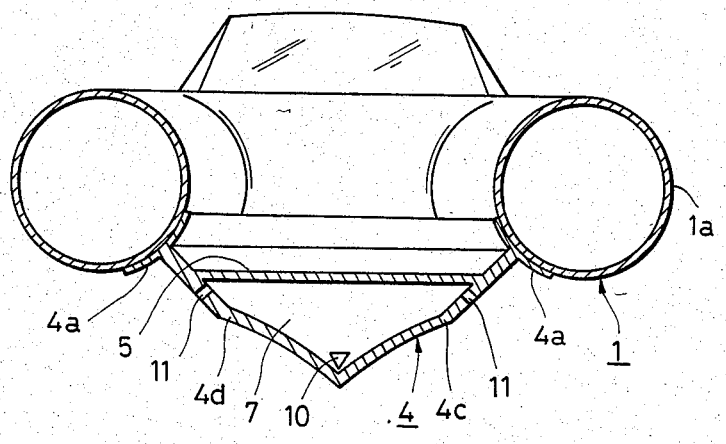
FIG. 5 is a sectional view of the boat taken along lines A—A in FIG. 4.

A water ballast chamber 4 is fixedly provided under the pair of sponsons 1*a*, 1*a* and the transom 2. The water ballast chamber 4 is elongated in longitudinal direction of the boat and is generally of a triangular cross section as shown in FIG. 5. The chamber 4 has a U-shaped upper edge portion 4*a* in the form of a concaved flange complementary to the arc of the tube 1 and is bonded at this upper edge portion 4*a* to the tube 1 as best seen in FIG. 5. The chamber 4 is also secured to the transom 2 at the upper edge of its rear wall 4*b* by bonding or any other known manner.

The chamber 4 has an upper wall 5 which serves also as the floor of the boat. The walls of the water ballast chamber 4 and a partition wall 6 to be described below may be made of fiberglass reinforced plastic, plywood, aluminium or other suitable material.

The transversely extending partition wall 6 is provided at a suitable location in the water ballast chamber 4, e.g., a location where it divides the chamber 4 in substantially equal lengths as in the illustrated embodiment, in such a manner that it divides the chamber 4 into a front compartment 7 and a rear compartment 8.

The rear wall 4*b* of the rear compartment 8 is formed in its lower portion with an opening 9 which communicates the rear compartment 8 with the outside. The partition wall 6 is formed in its lower portion with an opening or aperture 10 which communicates the front and rear compartments 7 and 8 with each other. The area of the opening 10 is preferably made smaller than the area of the opening 9 to restrict the flow of water from the front compartment 7 to the rear compartment 8 in the initial stage of planing.

Figure 4:
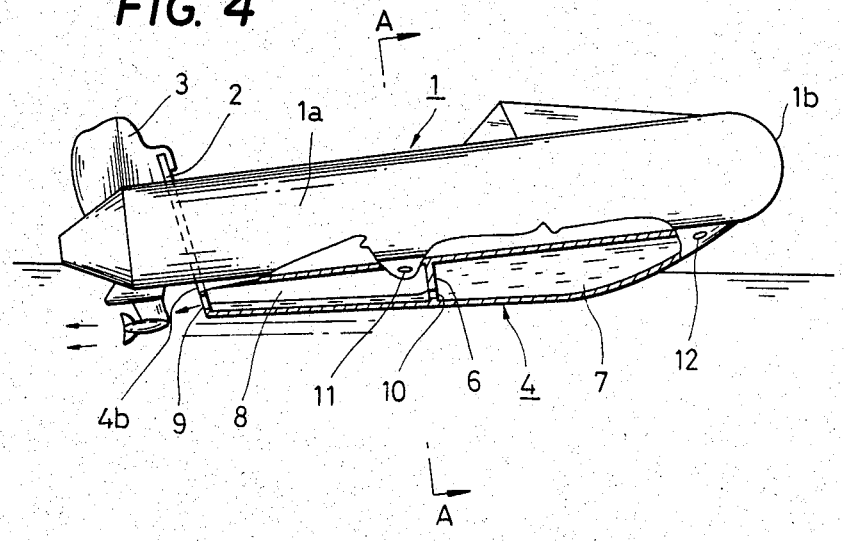
FIG. 4 is a partly sectional side view showing the planing type boat of FIG. 1 at the start of planing.

In addition to these openings 9 and 10, communicating means are provided in each of the front and rear compartments 7 and 8 for communicating the inside of each compartment with the outside of the water ballast chamber 4. In the embodiment shown in FIGS. 3 through 5, apertures 11 formed in upper front portions in the rear compartment section of both side walls 4*c*, 4*d* and apertures 12 formed in front upper portions in the front compartment section of the side walls 4*c*, 4*d* constitute the communicating means.

Figure 6:
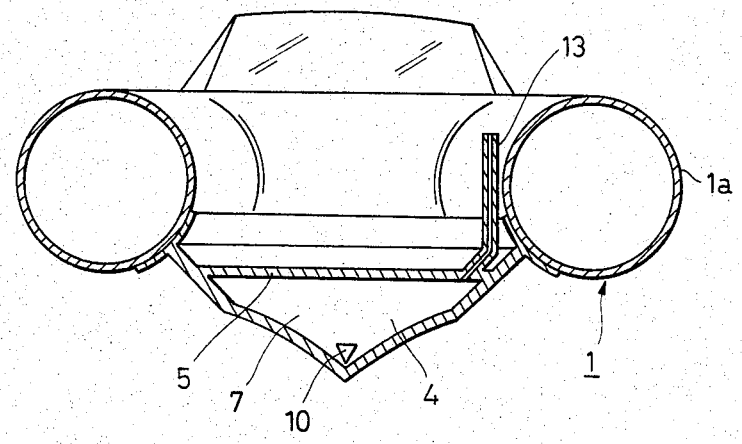
FIG. 6 is a sectional view similar to FIG. 5 showing a modified example of communicating means.

FIG. 6 shows another embodiment of the invention in which the communicating means in the rear compartment is constructed in the form of a pipe 13 projecting upwardly through the upper wall 5 instead of the openings 11.

In the above described embodiments, the partition wall 6 is provided at the location where the water ballast chamber 4 is divided in equal lengths. The location of the partition wall 6 however is not limited to this but may be shifted forwardly or rearwardly of the location in FIG. 3 depending upon desired running performances of the boat such as stability and speeds. The partition wall 6 may be of any desired configuration including an oblique one and a bent one.

The shape, number, area and location of the opening 10 formed in the partition wall 6 may be suitably determined depending upon desired running performances of the boat. Similarly, the shapes, numbers, areas and locations of the opening 9 formed in the rear wall 4*b* and those of the communicating means provided in the front and rear compartments 7 and 8 may be suitably selected depending upon the desired running performances of the boat.

The operation of the above described embodiments of the planing type boat will now be described.

When the boat is not in motion as shown in FIG. 3, the front and rear compartments 7 and 8 of the water ballast chamber 4 are filled with water which enters these compartments mainly through the opening 9 and also through the other openings 10, 11 and 12. This causes the waterline of the boat to rise and contributes to increasing the stability of the boat.

When the boat has started planing, the water in the rear compartment 8 is fastly discharged through the opening 9 by a combined action of inertia, gravity and aspiration induced by the outside flow of water in the vicinity of the opening 9 and also with the aid of the incoming air from the openings 11. On the other hand, the water in the front compartment 7 is also discharged through the opening 10 of the partition wall 6 but the rate of discharge of the water in the front compartment 7 is smaller than that of the water in the rear compartment 8 owing to the partition wall structure so that there arises a delay in the discharge of the water in the front compartment 7. Accordingly, the weight of water substantially acts on the front compartment 7 in the initial state of planing. This prevents the bow of the boat from being lifted excessively and thereby enables the boat to smoothly enter a complete planing state, thus reducing the time required for entering a complete planing state to the nimimum. During planing, both the front and rear compartments of the water ballast chamber are empty so that the boat can plane smoothly at a minimum weight and maximum buoyancy.

The above description has been made about the case where the invention has been applied to the boat whose sponsons and bow are made of an end-open inflatable tube. The scope of the invention however is not limited to this type of boat but it is applicable to a wide variety of planing type boats other than the above described one.

What we claim is:

1. A planing type boat having a water ballast chamber provided at the bottom of the boat comprising:

a partition wall provided in said water ballast chamber to divide said water ballast chamber into front and rear compartments and formed with an opening for communicating said front and rear compartments with each other, a rear wall of said rear compartment being formed with an opening; and communicating means provided in each of said front and rear compartments for communicating the inside of said front and rear compartments with the outside of said water ballast chamber, the area of said opening formed in said partition wall being smaller than the area of said opening formed in the rear wall of said rear compartment.

2. A planing type boat as defined in claim 1 wherein said communicating means in said front compartment is provided in the upper front portion of said front compartment.

3. A planing type boat as defined in claim 1 wherein said boat comprises a generally U-shaped inflatable tube constituting a pair of laterally spaced sponson sections connected together at the forward ends by a bow section and a transom extending transversely between aft end portions of said sponson sections, and wherein said water ballast chamber serves also as a boat floor provided under said inflatable tube and said transom.

4. A planing type boat as defined in claim 1 wherein said communicating means in said rear compartment is provided in the upper front side portion of said rear compartment.

* * * * *

UNITED STATES PATENT AND TRADEMARK OFFICE

CERTIFICATE OF CORRECTION

PATENT NO. : 4,528,927

DATED : July 16, 1985

INVENTOR(S) : IIZUKA, Yoshinori

It is certified that error appears in the above-identified patent and that said Letters Patent is hereby corrected as shown below:

Title page, after [73] Assignee", delete --501--

Signed and Sealed this

Fourteenth Day of October, 1986

[SEAL]

*Attest:*

DONALD J. QUIGG

*Attesting Officer*

*Commissioner of Patents and Trademarks*